US006930444B2

(12) United States Patent
Lee et al.

(10) Patent No.: US 6,930,444 B2
(45) Date of Patent: Aug. 16, 2005

(54) COLOR SELECTION APPARATUS INCLUDING FRAME SUPPORTING TENSION MASK FOR CATHODE RAY TUBE

(75) Inventors: Jae-Wook Lee, Yangsan (KR); Su-Jong Lee, Busan (KR); Sang-Bong Park, Busan (KR); Myung-Sup Seo, Busan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 53 days.

(21) Appl. No.: 10/422,586

(22) Filed: Apr. 25, 2003

(65) Prior Publication Data

US 2003/0230963 A1 Dec. 18, 2003

(30) Foreign Application Priority Data

Jun. 12, 2002 (KR) ..... 10-2002-0032912

(51) Int. Cl.[7] ..... H01J 29/80
(52) U.S. Cl. ..... 313/407; 313/402; 313/409
(58) Field of Search ..... 313/402–407, 313/409

(56) References Cited

U.S. PATENT DOCUMENTS 5,416,380 A * 5/1995 Horiuchi ..... 313/407
6,566,798 B2 * 5/2003 Watanabe et al. ..... 313/407

FOREIGN PATENT DOCUMENTS

| | | | | |
|---|---|---|---|---|
| EP | 1168411 A1 | * | 1/2002 | ..... H01J/29/07 |
| JP | 2002008554 A | * | 1/2002 | ..... H01J/29/07 |
| KR | 2002066152 A | * | 8/2002 | ..... H01J/29/02 |
| NL | WO 00/11701 | * | 3/2000 | ..... H01J/29/07 |

* cited by examiner

*Primary Examiner*—Ashok Patel
*Assistant Examiner*—Sikha Roy
(74) *Attorney, Agent, or Firm*—Robert E. Bushnell, Esq.

(57) ABSTRACT

A color selection apparatus for a cathode ray tube includes a tension mask including a plurality of electron beam passage apertures; and a frame including a pair of support members provided along opposite sides of the tension mask and applying a tensile force to the mask, and a pair of elastic members extending from one support member to the other at ends of the same, the elastic members maintaining a predetermined distance between the support members. Each of the elastic members is hollow and includes a base that is substantially parallel to the tension mask, with extensions formed substantially perpendicular to the base at both ends thereof, and bending portions integrally formed between the base and the extensions. Reinforcing elements are formed in proximity to the bending portions to increase the strength of the elastic members in the area of the bending portions.

20 Claims, 5 Drawing Sheets

COLOR SELECTION APPARATUS INCLUDING FRAME SUPPORTING TENSION MASK FOR CATHODE RAY TUBE

CLAIM OF PRIORITY

This application makes reference to, incorporates the same herein, and claims all benefits accruing under 35 U.S.C. §119 from an application for MASK ASSEMBLY FOR CATHODE RAY TUBE earlier filed in the Korean Industrial Property Office on 12 Jun. 2002 and there duly assigned Ser. No. 2002-32912.

BACKGROUND OF THE INVENTION

1. Field of the Invention

The present invention relates to a cathode ray tube, and more particularly, to a color selection apparatus having a tension mask that performs a color selection function for the realization of color images in a cathode ray tube.

2. Description of the Related Art

A cathode ray tube (CRT) is typically a display device in which three electron beams emitted from an electron gun scan a phosphor screen to realize predetermined images. A color selection apparatus is provided within a bulb that forms an exterior of the CRT and at a position next to the phosphor screen. The color selection apparatus includes a shadow mask that separates the three electron beams so that the electron beams land correctly on red (R), green (G), and blue (B) phosphor layers of the phosphor screen, and a frame for supporting the shadow mask.

The shadow mask of the color selection apparatus is formed by performing a photolithography process on aluminum-killed steel or INVAR steel of an extremely small thickness to form a plurality of electron beam passage apertures, after which drawing is performed to realize the final desired form. Since the thickness of the shadow mask is extremely small relative to its area, and because of the formation of hundreds of thousands of the apertures, the shadow mask becomes structurally weak. This leads to the shadow mask becoming depressed after receiving an outside shock or thermal expansion (i.e., doming) toward the phosphor screen as a result of the electron beams that do not pass through the apertures striking the shadow mask.

With such deformation of the shadow mask, the positioning of the apertures is altered from a state at which it is initially formed such that precise color selection of the electron beams does not occur. This causes mislanding of the electron beams to thereby result in reduced color purity of the screen.

Therefore, to overcome this problem and also enable manufacture of large screen sizes and flatter profiles, shadow masks have been developed that are fixed to a frame while in a state of tension (hereinafter referred to as a tension mask).

A conventional color selection apparatus for a cathode ray tube includes a tension mask that has formed in an inner area thereof a plurality of electron beam apertures. The tension mask is fixed to support members of a frame in a state where the tension mask receives tension along a direction of its short sides. The tension mask is fixed to mounting portions of the support members by welding the tension mask to the mounting portions. Also, an elastic member extends between the two support members on both sides of the tension mask to thereby complete the structure of the frame.

First, in a state whereby they are connected to the elastic members, a force of a predetermined magnitude is applied to the support members in a direction toward each other so that the support members are positioned closer together. As a result, the elastic members are elastically deformed at bending portions such that the elastic members and the support members provided thereon are positioned as shown by the dotted lines in the drawing.

In this state, the tension mask is fixed by welding to the support members 106, after which the force is removed. Therefore, the elastic members return toward their original position, that is, the elastic members return toward a position that is parallel to a resistive force of the tension mask. Tension is formed in the tension mask as a result.

However, with the bending of both ends of each of the elastic members as described above, permanent depressions are formed in the bending portions. The depressions weaken the bending portions of the elastic members so that an insufficient tensile force is supplied to the tension mask by the elastic members.

Further, after the tension mask is welded to the support members of the frame, there results a significant difference (of approximately 4 mm) between an amount of plastic deformation at ends and at center areas of the support members. This difference in deformation amounts along a length of the support members results in differences in the amount of tension of the tension mask over the same area.

A direct consequence of the tension mask having different levels of tension over its area is that the tension mask exhibits differences in natural frequency depending on location. If the CRT utilizing such a conventional color selection apparatus is mounted in a television, for example, the sound output from the speakers affects the tension mask such that distances between the same and the phosphor screen vary to differing degrees depending on the location of the tension mask. As a result, the electron beams passing through the apertures of the tension mask do not land on their intended positions (i.e., the intended phosphors) so that picture quality deteriorates.

In sum, as a result of the depressions formed in the elastic members of the frame in the conventional color selection apparatus, an insufficient amount of tension is applied to the tension mask such that the mask vibrates to ultimately result in a deteriorated picture quality. This problem is made worse by the fact that the amount of tension applied to the tension mask varies at different locations so that the tension mask vibrates differently at different areas.

SUMMARY OF THE INVENTION

It is one object of the present invention to provide a color selection apparatus for a cathode ray tube that minimizes plastic deformation generated during welding of a tension mask to prevent is a reduction in picture quality resulting from vibration characteristics.

It is another object of the present invention to provide a color selection apparatus for a cathode ray tube that includes a greater support for tension allowing for greater tension to the mask, and thus improving the vibration characteristics of the cathode ray tube.

It is yet another object of the present invention to provide a color selection apparatus for a cathode ray tube that minimizes deformation and is easy to implement and inexpensive to manufacture.

In a preferred embodiment, the present invention provides a color selection apparatus for a cathode ray tube including a tension mask including a plurality of electron beam passage apertures; and a frame including a pair of support members provided along opposite sides of the tension mask and applying a tensile force to the mask, and a pair of elastic members extending from one support member to the other at ends of the same, the elastic members maintaining a predetermined distance between the support members.

Each of the elastic members is hollow and includes a base that is substantially parallel to the tension mask, extensions formed substantially perpendicular to the base at both ends thereof, and bending portions integrally formed between the base and the extensions. Reinforcing elements are formed in proximity to the bending portions to increase the strength of the elastic members in the area of the bending portions.

The reinforcing elements are formed in the bending portions, the bases, or the bending portions and the bases of the elastic members. It is preferable that the reinforcing elements are grooves formed in a surface of the elastic members facing the tension mask.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 7:
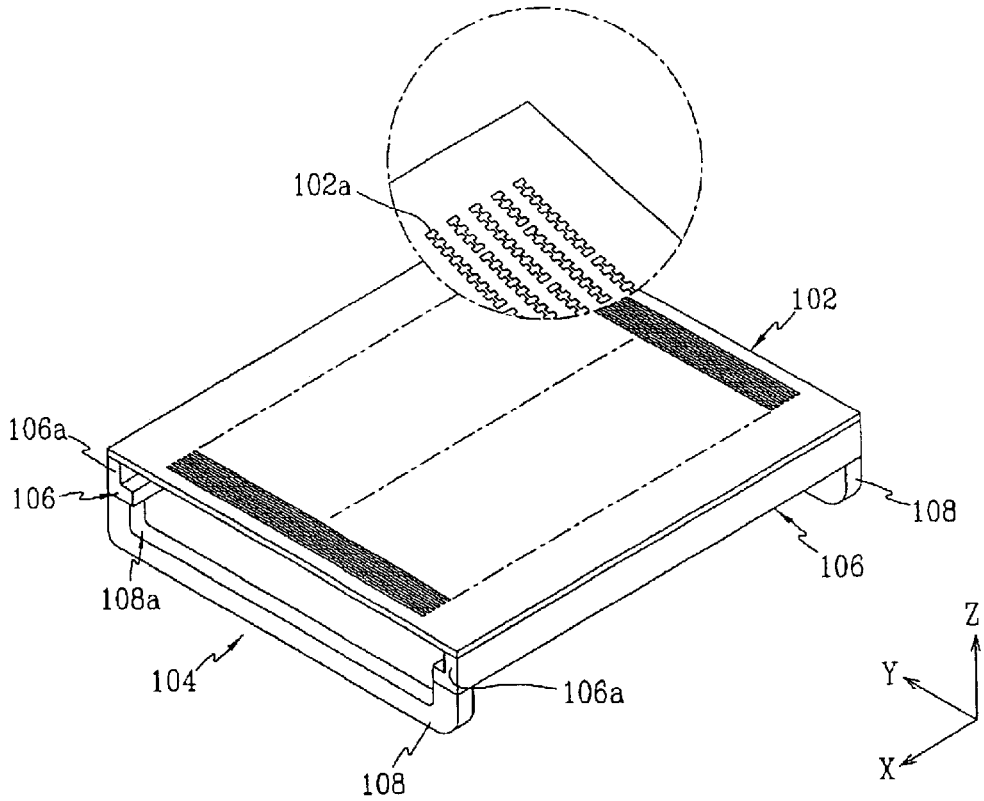
FIG.7 (Related Art)
FIG. 7 is a perspective view of a conventional color selection apparatus for a cathode ray tube.

Turning now to the drawings, FIG. 7 is a perspective view of a conventional color selection apparatus for a cathode ray tube. As shown in the drawing, the color selection apparatus includes a tension mask 102 that has formed in an inner area thereof a plurality of electron beam apertures 102*a*. The tension mask 102 is fixed to support members 106 of a frame 104 in a state where the tension mask 102 receives tension along a direction of its short sides (i.e., along a vertical direction or an axis Y direction in the drawing). The tension mask 102 is fixed to mounting portions 106*a* of the support members 106 by welding the tension mask 102 to the mounting portions 106*a*. Also, an elastic member 108 extends between the two support members 106 in the axis Y direction on both sides of the tension mask 102 to thereby complete the structure of the frame 104.

Figure 8:
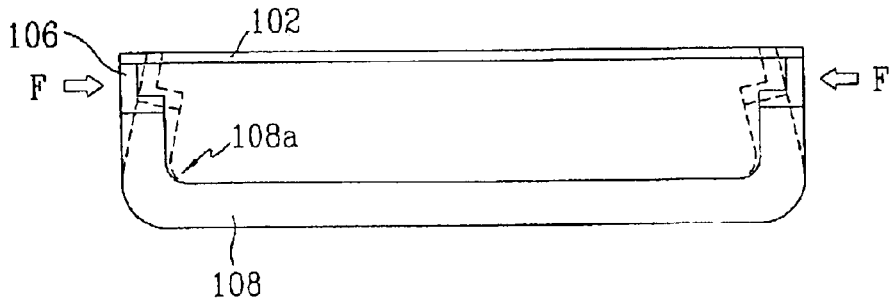
FIG.8 (Related Art)
FIG. 8 is a side view of the color selection apparatus of FIG. 7.

The assembly of the tension mask 102 to the frame 104 will now be described with reference to FIG. 8. First, in a state whereby they are connected to the elastic members 108, a force (F) of a predetermined magnitude is applied to the support members 106 in a direction toward each other so that the support members 106 are positioned closer together. As a result, the elastic members 108 are elastically deformed at bending portions 108*a* such that the elastic members 108 and the support members 106 provided thereon are positioned as shown by the dotted lines in the drawing.

In this state, the tension mask 102 is fixed by welding to the support members 106, after which the force (F) is removed. Therefore, the elastic members 108 return toward their original position, that is, the elastic members 108 return toward a position that is parallel to a resistive force of the tension mask 102. Tension is formed in the tension mask 102 as a result.

Figure 9:
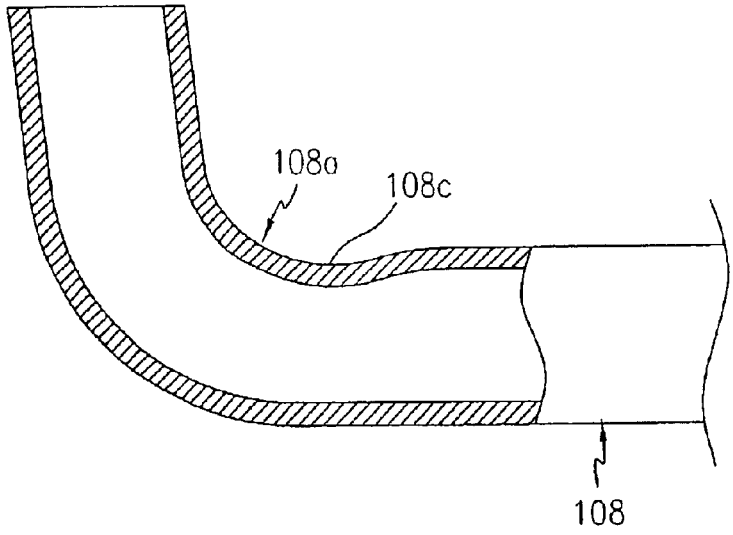
FIG.9 (Related Art)
FIG. 9 is a partial sectional view of elastic members of the color selection apparatus of FIG. 7.

However, with the bending of both ends of each of the elastic members 108 as described above, permanent depressions 108*c* are formed in the bending portions 108*a* as shown in FIG. 9. The depressions 108*c* weaken the bending portions 108*a* of the elastic members 108 so that an insufficient tensile force is supplied to the tension mask 102 by the elastic members 108.

Further, after the tension mask 102 is welded to the support members 106 of the frame 104, there results a significant difference (of approximately 4 mm) between an amount of plastic deformation at ends and at center areas of the support members 106. This difference in deformation amounts along a length of the support members 106 results in differences in the amount of tension of the tension mask 102 over the same area.

A direct consequence of the tension mask 102 having different levels of tension over its area is that the tension mask 102 exhibits differences in natural frequency depending on location. If the CRT utilizing such a conventional color selection apparatus is mounted in a television, for example, the sound output from the speakers affects the tension mask 102 such that distances between the same and the phosphor screen vary to differing degrees depending on the location of the tension mask 102. As a result, the electron beams passing through the apertures 102*a* of the tension mask 102 do not land on their intended positions (i.e., the intended phosphors) so that picture quality deteriorates.

In sum, as a result of the depressions formed in the elastic members of the frame in the conventional color selection apparatus, an insufficient amount of tension is applied to the tension mask such that the mask vibrates to ultimately result in a deteriorated picture quality. This problem is made worse by the fact that the amount of tension applied to the tension mask varies at different locations so that the tension mask vibrates differently at different areas.

Preferred embodiments of the present invention will now be described in detail with reference to the accompanying drawings.

Figure 1:
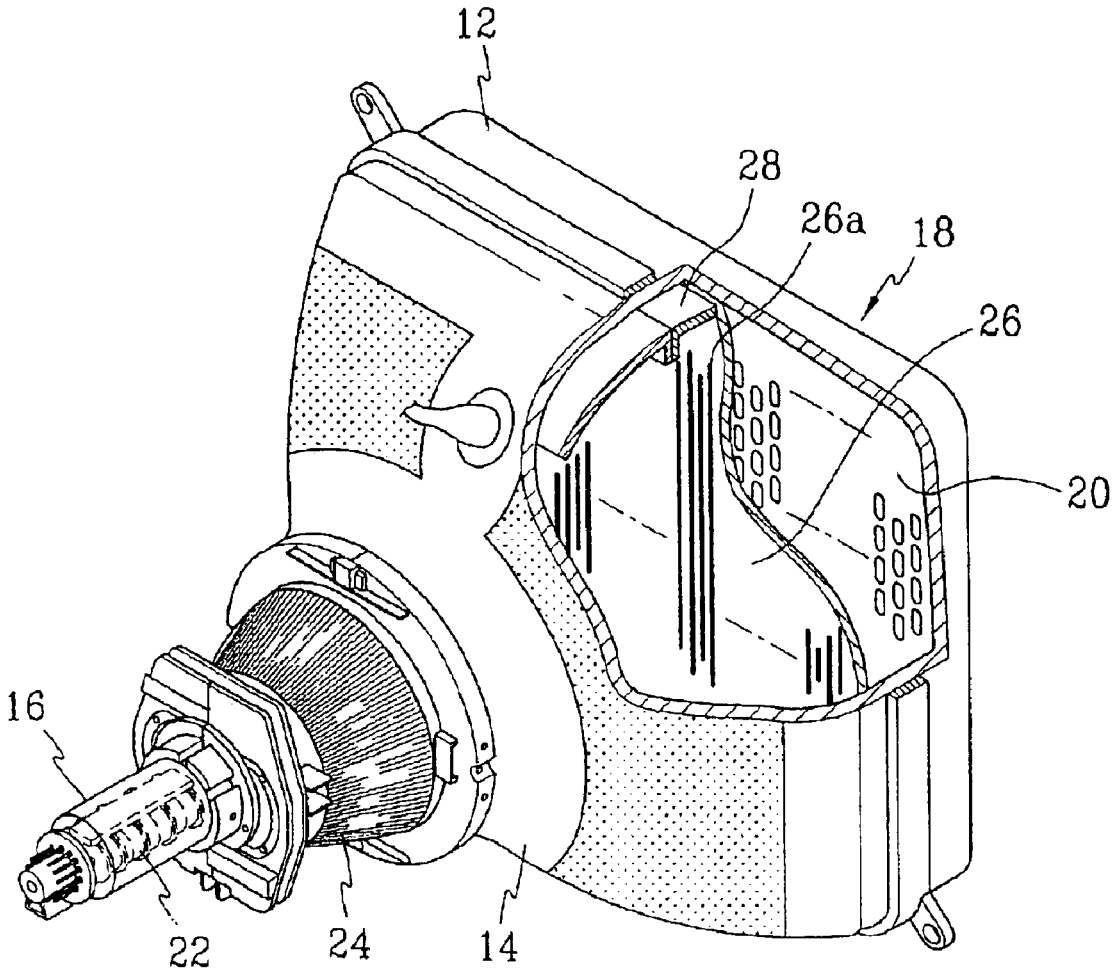
FIG. 1 is a partially cutaway perspective view of a cathode ray tube according to a preferred embodiment of the present invention.

FIG. 1 is a partially cutaway perspective view of a cathode ray tube according to a preferred embodiment of the present invention. The cathode ray tube (CRT) is defined by a vacuum tube 18 that is realized by fusing a face panel 12, a funnel 14, and a neck 16 into an integral unit. A phosphor screen 20 that has sequentially formed thereon red (R), green (G), and blue (B) phosphor layers is provided on an inner surface of the face panel 12. Also, an electron gun 22 that emits toward the phosphor screen 20 three electron beams corresponding to the R, G, and B phosphor layers is mounted within the neck 16, and a deflection yoke 24 for generating horizontal and vertical deflection magnetic fields to allow for the scanning of the entire phosphor screen 20 by the electron beams is mounted on an outer circumference of the funnel 14.

A substantially rectangular mask 26 including a plurality of electron beam passage apertures 26*a* is mounted within the tube 18 at a predetermined distance from the phosphor screen 20. The mask 26 allows for the precise color separation of the electron beams to the corresponding R (red), G (green), and B (blue) phosphor layers. The mask 26 is a tension mask that is fixed to a frame 28 in a state of receiving tension in both long side and short side directions. In the preferred embodiment of the present invention, the frame 28 is structured so that a greater tension may be provided to the tension mask 26.

Figure 2:
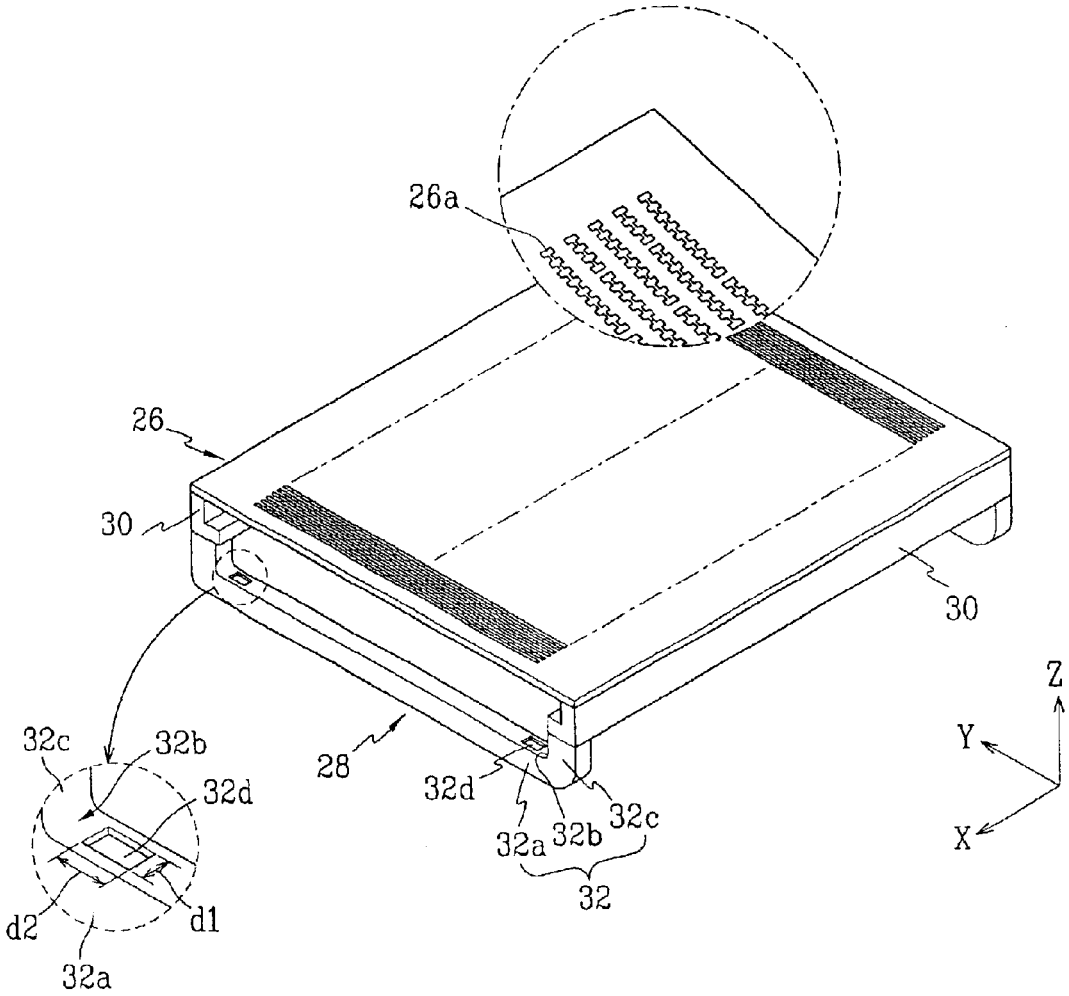
FIG. 2 is a perspective view of a color selection apparatus of FIG. 1.

FIG. 2 is a perspective view of a color selection apparatus of FIG. 1. The color selection apparatus includes the tension mask 26 and the frame 28.

The tension mask 26 is mounted to the frame 28 receiving tension mainly in a vertical direction of the phosphor screen 20 (axis Y direction in the drawing). The frame 28 includes a pair of support members 30 provided in an axis X direction of the drawing opposite long sides of the tension mask 28, and a pair of elastic members 32 extending from one support member 30 to the other in the axis Y direction and at ends of each of the support members 30.

Each of the elastic members 32 includes a base 32*a* that is substantially parallel to the tension mask 26, extensions 32*c* formed substantially perpendicular to the base 32*a* at both ends thereof, and bending portions 32*b* integrally formed between the base 32*a* and the extensions 32*c*. The elastic members 32 are preferably hollow.

Figure 3:
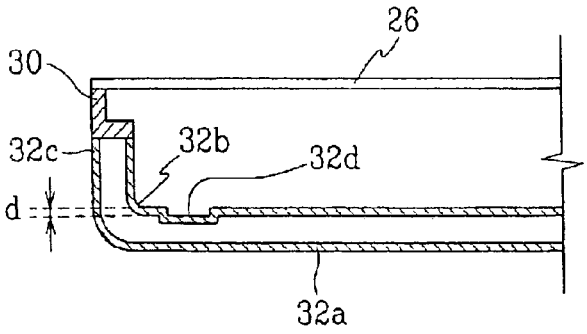
FIG. 3 is partial sectional view of the color selection apparatus of FIG. 2.
Figure 4:
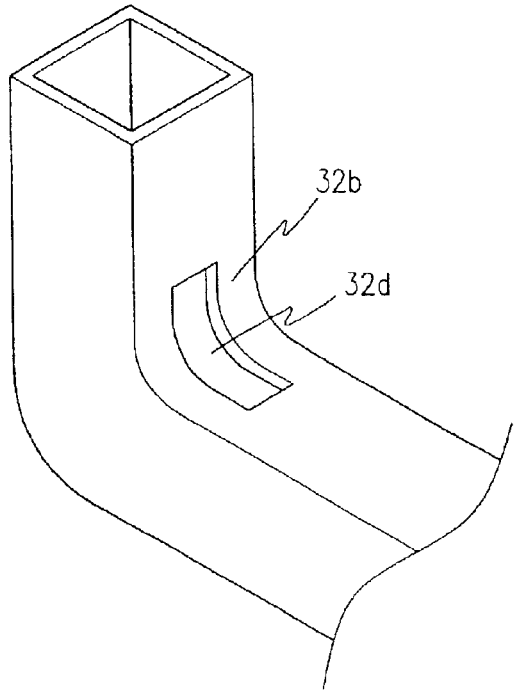
FIGS. 4 and 5 are partial sectional views of elastic members of the color selection apparatus of FIG. 2.
Figure 5:
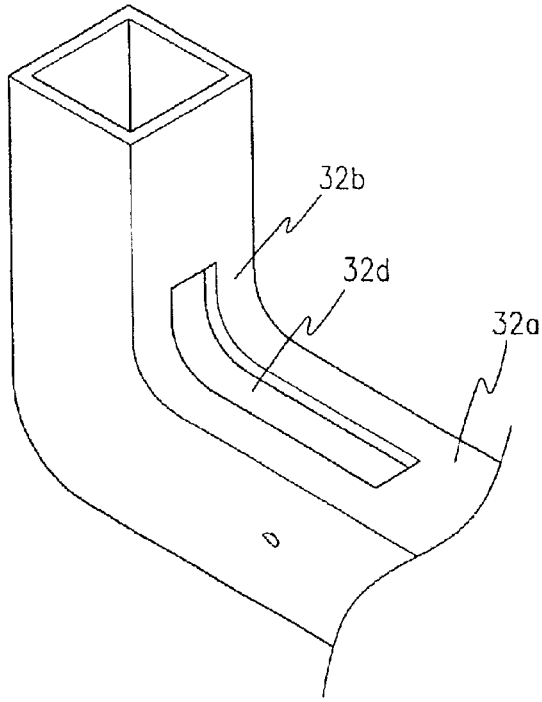

To increase the strength of the elastic members 32 in the area of the bending portions 32*b*, reinforcing elements 32*d* are formed in proximity to the bending portions 32*b*. With reference also s to FIG. 3, the reinforcing elements 32*d* are realized through grooves that are preferably formed in a surface of the bases 32*a* of the elastic members 32 facing the tension mask 26. However, the reinforcing elements 32*d* may also be formed in the bending portions 32*b* of the elastic members 32 as shown in FIG. 4, or in the bending portions 32*b* and extending a predetermined distance into the bases 32*a* as shown in FIG. 5. The size and position of the reinforcing elements 32*d* as described above are selected depending on the type of CRT to which the color selection apparatus is applied and on the desired strength of the bending portions 32*b* of the elastic members 32.

The reinforcing elements 32*d* may be formed during the shaping of the elastic members 32. That is, the reinforcing elements 32*d* may be formed when the extensions 32*c* of each of the elastic members 32 are formed by bending both ends of the base 32. It is preferable that the reinforcing elements 32*d* are formed into rectangular shapes having long sides along the axis Y direction. Also, it is preferable that a depth (d) of the reinforcing elements 32*d* is between 0.1 and 1.5 mm (millimeters). If the depth (d) of the reinforcing elements 32*d* is less than 0.1 mm, only a minimal reinforcing effect of the bending portions 32*b* is realized, while if the depth (d) of the reinforcing elements 32*d* exceeds 1.5 mm, the reinforcing elements 32*d* themselves become difficult to form. Therefore, it is also preferable that a depth (d) of the reinforcing elements 32*d* is from and including 0.1 to and including 1.5 mm.

Further, in the case where the reinforcing elements 32*d* are formed as rectangular grooves as described above, it is preferable that a ratio of a short side length (d1) to a long side length (d2) is 1:1.5. Such a ratio produces the best results and was obtained through countless experimentation trials.

Figure 6:
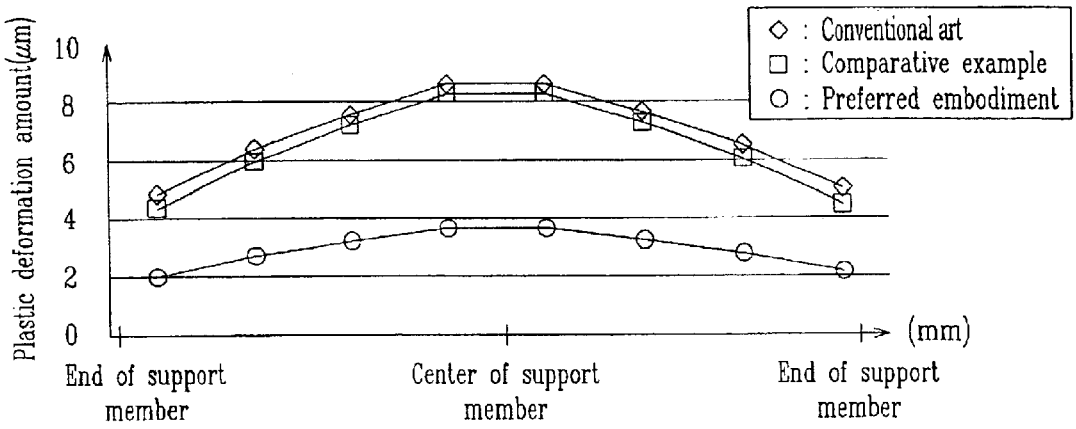
FIG. 6 is a graph showing plastic deformation amounts depending on location of the color selection apparatus of FIG. 2 and of conventional color selection apparatuses.

FIG. 6 is a graph showing plastic deformation amounts depending on location of the color selection apparatus of the present invention, of a conventional color selection apparatus, and of a comparative example. To obtain the measurements, all the color selection apparatuses were applied to CRTs having a 32-inch screen (diagonal measurement). The color selection apparatus of the comparative example includes reinforcing members, but they are square rather than rectangular as in the present invention.

Also, in FIG. 6, the plastic deformation amount refers to the amount of deformation of the support members of the present invention, and of the conventional and comparative example devices, after the tension masks are welded to the support members. That is, the difference between measurements taken before the tension masks are welded to the support members and following the release of the force applied to the support members after welding is complete is the plastic deformation amount. In addition, the plastic deformation amounts appearing in the graph are measured at eight different points along lengths of the support members.

As shown in FIG. 6, the conventional color selection apparatus (i.e., the conventional support members) and the color selection apparatus of the comparative example display substantial plastic deformation amounts at all areas, with the difference in deformation amounts between centers and ends of the support members being significant. On the other hand, in the color selection apparatus according to the preferred embodiment of the present invention, plastic deformation amounts at all areas is reduced over the conventional and comparative example color selection apparatuses, and the difference in plastic deformation between centers and ends of the support members is also minimized.

In the color selection apparatus for a cathode ray tube of the present invention, grooves are formed in the elastic members to reinforce the strength of the bending portions to thereby effectively prevent a reduction in this strength during formation processes of the elastic members. As a result, deformation of the frame occurring after the tension mask is welded thereto is minimized such that variations in mask shape and tension are prevented. Also, the frame is able to support a greater tension, which allows for the application of a greater tension to the mask. This improves vibration characteristics of the CRT.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A color selection apparatus for a cathode ray tube, comprising:

a tension mask including a plurality of electron beam passage apertures; and a frame including a pair of support members provided along opposite sides of said tension mask and applying a tensile force to said mask, and a pair of elastic members extending from one support member to the other at ends of said support members, said elastic members maintaining a predetermined distance between said support members, with each of said elastic members being hollow and longitudinally enclosing the hollow portion, and including a base being substantially parallel to said tension mask, extensions formed substantially perpendicular to said base at both ends of said base, and bending portions integrally formed between said base and said extensions, and with reinforcing elements being formed in proximity to said bending portions, with said reinforcing elements including grooves of a certain depth formed on a surface of the enclosed said elastic members with the grooves including side walls and a bottom wall.

2. The color selection apparatus of claim 1, wherein said reinforcing elements are formed in said bending portions of said elastic members.

3. The color selection apparatus of claim 1, wherein said reinforcing elements are formed in said bases of said elastic members.

4. The color selection apparatus of claim 1, wherein said reinforcing elements are formed in said bending portions and in said bases of said elastic members.

5. The color selection apparatus of claim 1, wherein said reinforcing elements are grooves with the bottom wall and no openings formed in a surface of said elastic members facing said tension mask.

6. The color selection apparatus of claim 5, wherein a depth of said reinforcing elements is between 0.1 and 1.5 mm.

7. The color selection apparatus of claim 5, wherein said reinforcing elements are substantially rectangular having long sides along a length of said bases of said elastic members.

8. A color selection apparatus for a cathode ray tube, comprising:

a tension mask including a plurality of electron beam passage apertures; and a frame including a pair of support members provided along opposite sides of said tension mask and applying a tensile force to said mask, and a pair of elastic members extending from one support member to the other at ends of said support members, said elastic members maintaining a predetermined distance between said support members, with each of said elastic members being hollow and including a base being substantially parallel to said tension mask, extensions formed substantially perpendicular to said base at both ends of said base, and bending portions integrally formed between said base and said extensions, and with reinforcing elements being formed in proximity to said bending portions, wherein a ratio of a length of short sides of said reinforcing elements to a length of long sides of said reinforcing elements is 1:1.5.

9. A color selection apparatus for a display device, comprising:

a tension mask; and a frame supporting said tension mask, said frame comprising:

a pair of support members provided along opposite sides of said tension mask and applying a tensile force to said mask;

a pair of elastic members extending from one support member to the other at ends of said support members; and reinforcing elements being formed on said elastic members facing said tension mask, with each one of the reinforcing elements being a depressed chamber formed from only a certain portion of a top surface facing said tension mask of the elastic members and the certain portion of the top surface being depressed into the chamber.

10. The color selection apparatus of claim 9, with each of said elastic members being hollow and covering the hollow portion lengthwise.

11. The color selection apparatus of claim 9, with each of said elastic members comprising:

a base being substantially parallel to said tension mask;

extensions formed substantially perpendicular to said base at both ends of said base; and bending portions integrally formed between said base and said extensions, with said reinforcing elements being formed in proximity to said bending portions.

12. The color selection apparatus of claim 11, with said reinforcing elements being formed in only said bending portions of said elastic members.

13. The color selection apparatus of claim 11, with said reinforcing elements being formed in only said bases of said elastic members.

14. The color selection apparatus of claim 11, with said reinforcing elements being formed in said bending portions and in said bases of said elastic members.

15. The color selection apparatus of claim 11, with said reinforcing elements being grooves forming the depressed chambers formed in only the top surface of said elastic members facing said tension mask.

16. The color selection apparatus of claim 15, with a depth of said reinforcing elements being between 0.1 and 1.5 mm.

17. The color selection apparatus of claim 15, with a depth of said reinforcing elements being from and including 0.1 to and including 1.5 mm.

18. The color selection apparatus of claim 17, with said reinforcing elements being substantially rectangular and including long sides along a length of the bases of said elastic members.

19. A color selection apparatus for a display device, comprising:

a tension mask; and a frame supporting said tension mask, said frame comprising:

a pair of support members provided along opposite sides of said tension mask and applying a tensile force to said mask;

a pair of elastic members extending from one support member to the other at ends of said support members; and reinforcing elements being formed on said elastic members facing said tension mask, with each of said elastic members comprising:

a base being substantially parallel to said tension mask;

extensions formed substantially perpendicular to said base at both ends of said base; and bending portions integrally formed between said base and said extensions, with said reinforcing elements being formed in proximity to said bending portions, with said reinforcing elements being grooves formed in a surface of said elastic members facing said tension mask, with said reinforcing elements being substantially rectangular and including long sides along a length of the bases of said elastic members, a ratio of a length of short sides of said reinforcing elements to a length of the long sides of said reinforcing elements being 1:1.5, and said reinforcing elements being formed in at least one of a group consisting essentially of said bending portions and said bases of said elastic members.

20. A frame supporting a tension mask in a display device, comprising:

a pair of support members provided along opposite sides of said tension mask and applying a tensile force to said mask;

a pair of elastic members extending from one support member to the other at ends of said support members, with each of said elastic members comprising:

a base being substantially parallel to said tension mask;

extensions extending from said support members to said base at both ends of said base; and bending portions integrally formed between said base and said extensions; and reinforcing elements being formed only in proximity to said bending portions of said elastic members, said reinforcing elements being closed grooves facing said tension mask and substantially rectangular.

* * * * *